United States Patent [19]

Harrison et al.

[11] 4,210,098

[45] Jul. 1, 1980

[54] APPARATUS FOR TREATING INTERNAL SURFACES OF WALLS OF A TANK

[75] Inventors: David V. Harrison, Mold, Wales; Roy Weaver, Highland Stockport; Henry G. E. Wilson, Chester, both of England

[73] Assignee: Shell Internationale Research Maatschappij B.V., The Hague, Netherlands

[21] Appl. No.: 946,776

[22] Filed: Sep. 28, 1978

[30] Foreign Application Priority Data

Oct. 12, 1977 [GB] United Kingdom ..... 42467/77

[51] Int. Cl.[2] ..... B05C 5/00; B05C 7/02

[52] U.S. Cl. ..... 118/317; 118/323; 239/184; 51/429; 51/411

[58] Field of Search ..... 239/184; 51/429, 411; 118/306, 323, 317

[56] References Cited

U.S. PATENT DOCUMENTS 3,833,175 9/1974 Pulk ..... 239/184

FOREIGN PATENT DOCUMENTS 471122 8/1975 U.S.S.R. ..... 239/184

*Primary Examiner*—Sam Silverberg

*Attorney, Agent, or Firm*—Pravel, Gambrell, Hewitt, Kirk, Kimball & Dodge

[57] ABSTRACT

Tanks for seagoing tankers for transporting liquefied natural gas or liquefied methone are basically prismatic, wherein the corners between intersecting walls are rounded off so that in such tanks adjacent flat wall parts are interconnected by a curved wall part. The invention relates to an apparatus and a method for mechanically treating the inner surfaces of the walls of such a tank, wherein the apparatus is so constructed that it is able to displace a treating tool along the flat wall parts and along the curved wall parts in such a manner that these wall parts are treated in a similar manner so that the quality of the treatment will be the same for all the various wall parts. The apparatus is particularly useful for spraying an insulating material, for example a polyurethane foam, onto the inner surface of the walls of such a tank.

9 Claims, 3 Drawing Figures

APPARATUS FOR TREATING INTERNAL SURFACES OF WALLS OF A TANK

BACKGROUND OF THE INVENTION

1. Field Of Invention

The invention relates to an apparatus and to a method for treating the internal surfaces of walls of a tank, in particular for spraying an insulating material, for example a polyurethane foam, onto the tank walls, where the tank has at least two flat wall parts interconnected by a curved wall part.

2. Description Of Prior Art

Examples of tanks requiring treatment are the tanks of seagoing tankers for the transport of liquefied natural gas or liquefied methane. These tanks are basically prismatic, with the intersecting walls having been rounded off at the intersections, so that in such tanks adjacent flat wall parts are interconnected by a curved wall part.

When treating the internal surfaces of such tanks one of the problems is to control displacement of the treating tool along both the flat wall parts and the curved wall parts. Unless this is done, all wall parts are not treated in a similar manner and the quality of the treatment is not the same for all the various wall parts.

SUMMARY OF INVENTION

The apparatus according to the present invention comprises a trolley adapted to carry a treating tool, a first straight guide rail for the trolley adapted to be arranged parallel to and spaced apart from one of the flat wall parts of the tank walls and a second straight guide rail for the trolley adapted to be arranged parallel to and spaced apart from the other of the flat wall parts of the tank. A traverser carrying a straight guide rail for the trolley is arranged between said first and second guide rails in such a way that the traverser can rotate around an axis which coincides with the axis of curvature of the curved wall part. Means are provided for locking the trolley to the traverser wherein the traverser is adapted to rotate from a first position, wherein the guide rail on the traverser is in line with the first guide rail, to a second position, wherein the guide rail on the traverser is in line with the second guide rail. Driving means are present for displacing the trolley along the first guide rail, for displacing the trolley from the first guide rail onto the traverser, for rotating the traverser from the first to the second position while the trolley is locked on the traverser and for displacing the trolley from the traverser and along the second guide rail.

A suitable embodiment of the apparatus according to the invention comprises means for varying the angular velocity of the traverser around its axis and/or it comprises means for varying the velocity of the trolley along the guide rails.

A preferred embodiment of the apparatus according to the invention comprises means for establishing a predetermined relationship between the angular velocity of the traverser around its axis and the velocity of the trolley along the said guide rails.

In a suitable embodiment of the invention the driving means for displacing the trolley along the guide rails comprise a pinion on the trolley and a motor on the trolley for driving the pinion, with the pinion adapted to cooperate with a rack.

In a preferred embodiment of the invention the rack comprises a first straight rack arranged parallel to the first straight guide rail, a second straight rack arranged parallel to the second straight guide rail and a curved rack arranged between and interconnecting the first and second straight racks.

The trolley of the apparatus according to the present invention is adapted to carry any of several tools for treating a surface of an internal wall of a tank. In accordance with the present invention, the expression "treating a surface" is intended to include a number of operations, viz. spraying an insulating foam onto a surface, for example polyurethane foam; spraying a paint onto a surface; spraying an anti-corrosion material onto a surface; cleaning a surface; sandblasting a surface; grinding a surface; applying a laminate onto a surface; and even rolling a surface, in accordance with the treating operation to be preformed. Similarly the expression "treating tool" is intended to include a suitable surface treating tool such as a spraying tool, a cleaning tool, a sandblasting tool, a grinding tool, a laminating tool and a rolling tool, according to the treating operation.

It is an object of the invention to provide an apparatus and a method for control of the treatment of internal surfaces of walls of a tank.

BRIEF DESCRIPTION OF THE DRAWINGS

The invention will be further explained with reference to the drawings, wherein.

DESCRIPTION OF THE PREFERRED EMBODIMENT

Figure 1:
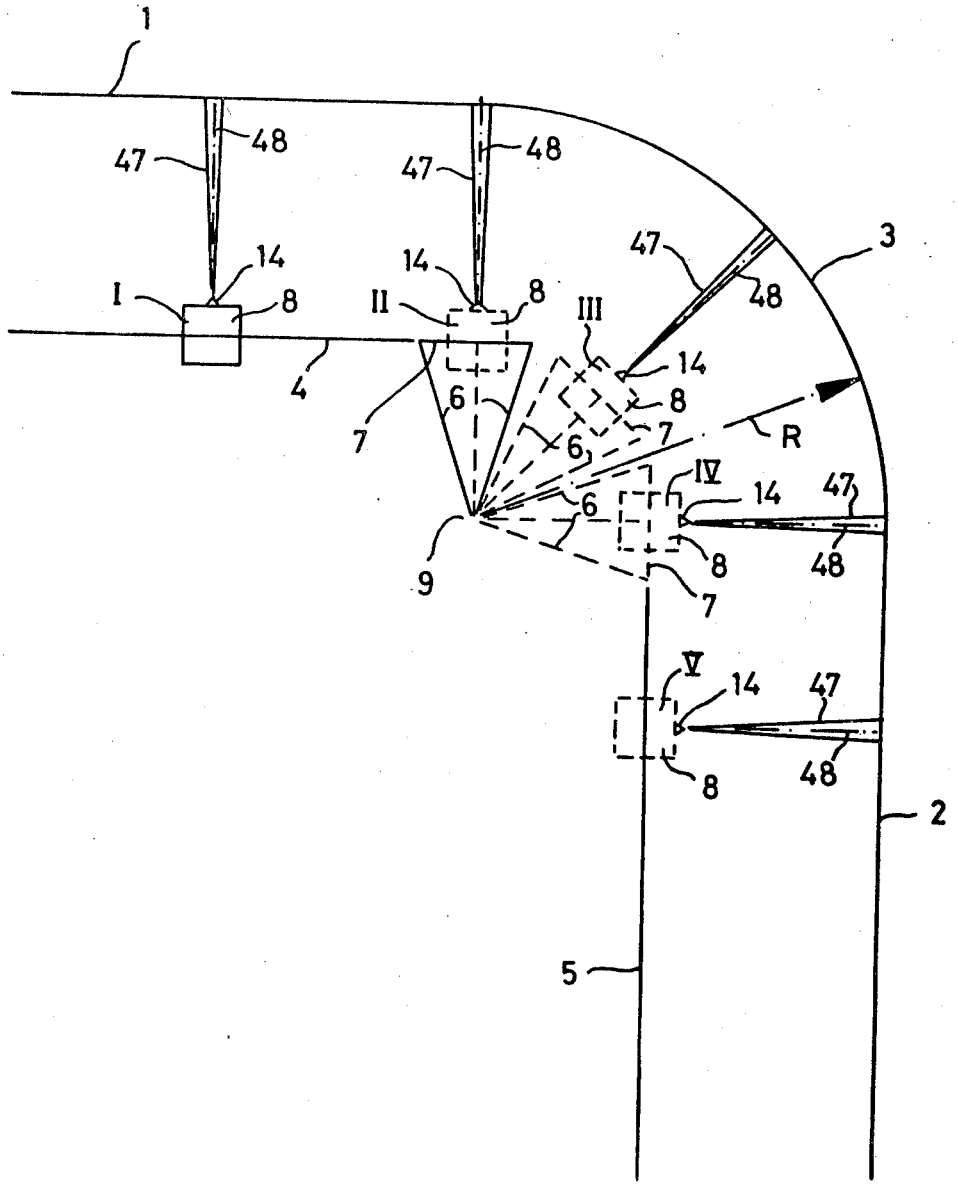
FIG. 1 is a schematic drawing for explanation of the operating principles of an apparatus according to the invention.

At the outset, in order to explain briefly the operating principle of how the surfaces of a tank can be treated by means of the apparatus according to the present invention, reference is made to FIG. 1.

In FIG. 1 flat tank wall parts 1 and 2 are interconnected by a curved wall part 3 which forms part of a cylinder, with the curved tank wall part 3 having a radius of curvature R about an axis of curvature 9. When it is desired to treat the inner surfaces of the wall parts 1, 2 and 3, for example by spraying a material, for example a polyurethane foam, onto these inner surfaces, the apparatus of the present invention, to be described in detail below, operates according to the principles set forth below.

A trolley 8 is provided with a spraying nozzle 14 mounted in such a way that it is directed to the surface to be treated. By means of the nozzle 14 a spraying cone 47 is formed of the material to be deposited on the surfaces to be treated. The longitudinal axis of the spraying cone 47 is indicated by the reference numeral 48. Various successive positions of the trolley 8 are indicated by reference numerals I, II, III, IV and V.

In order to treat the inner surface of flat wall part 1, the trolley 8 is caused to move at a certain predetermined velocity along a guide rail shown schematically at 4 (see reference numeral I), which is arranged parallel to the wall part 1. For this purpose means are present for varying the velocity of the trolley 8 along the guide rail 4, and also along guide rails 7 and 5 as mentioned below. By these means the proper velocity of the trolley 8 can be selected dependending on the treatment to be carried out on the inner surfaces of the wall parts 1, 2 and 3. The end of the longitudinal axis 48 of the spraying cone 47 moves along the inner surface of wall part 1 with a velocity which is the same as the velocity of the trolley 8. By keeping this velocity constant and the supply of material to the spraying nozzle 14 constant all the parts of inner surface of the flat wall part 1 are treated in the same manner so that equal quality of treatment of the wall surfaces is ensured.

When the trolley 8 has reached the end of the guide rail 4, it is moved onto a guide rail 7 on a traverser 6 (both shown schematically) until it has reached the position as indicated by reference numeral II. In that position the trolley 8 is locked to the traverser 6. Then the traverser 6 is caused to rotate around the axis 9 so that the traverser 6, together with the trolley 8, moves from position II through position III to position IV. During this rotation of the traverser 6 spraying is continued so that the inner surface of the curved wall part 3 is treated as desired. The angular velocity of the traverser 6 around the axis 9 is selected in such a manner that the end of the longitudinal axis 48 of the spraying cone 47 is displaced along the inner surface of the curved wall part 3 with the same velocity as along the inner surface of the flat wall part 1. For this purpose means are present according to the present invention for varying the angular velocity of the traverser 6 around its axis 9 and preferably means are present for establishing a predetermined relationship between the angular velocity of the traverser around its axis 9 and the velocity of the trolley 8 along the guide rails 4 and 5. The above means comprise for example a variable transmission (not shown) for driving a pinion 10 (as mentioned below) and a device for adjusting the variable transmission in such a manner that the pinion 10 rotates at a certain predetermined angular velocity when the trolley 8 is running along the guide rails 4 and 5 and that the pinion 10 rotates at another predetermined angular velocity when the trolley 8 is locked to the traverser 6. By keeping the supply of material to the spraying nozzle 14 constant as well, it is ensured that the inner surface of the curved wall part 3 receives a treatment which is of equal quality as the treatment of the inner surface of the flat wall part 1. As will be described in further detail below with reference to FIG. 2 this result is obtained by an adequate reduction of the angular velocity of a pinion 10 when it starts to run along a curved rack 13 (see FIG. 2).

When the traverser 6, together with trolley 8, has reached the position IV, the trolley 8 is unlocked from the traverser 6. The trolley 8 is then displaced along the straight guide rail 5, which is arranged parallel to the flat wall part 2. During this displacement of the trolley 8 along the guide rail 5, the velocity of the trolley 8 is caused to be the same as the velocity of the trolley 8 during its movement along the guide rail 4. As will be described in further detail below with reference to FIG. 2, this result is obtained by raising the angular velocity of the pinion 10 again to its original angular velocity when the pinion 10 was running along a first straight rack 11. Thus the pinion 10 will run along the rack 11 and a rack 12 with the same angular velocity.

By using the apparatus according to the invention as described above, the spraying nozzle 14 will always be kept at the same distance from the surfaces to be treated, viz. from the inner surfaces of flat wall part 1, curved wall part 3 and flat wall part 2. Furthermore, the apparatus according to the invention enables such operation that the end of the longitudinal axis 48 of the spraying cone 47 moves along the surfaces to be treated at the same constant velocity. By such movement, together with a constant supply of material to the spraying nozzle 14, it is possible to treat all the surfaces in the same manner, so that all the surfaces receive a treatment of the same quality.

Instead of the spraying nozzle 14, other tools can be mounted on the trolley 8. Examples of such other tools are mentioned above. When such other tools are used, it is also possible to give equal treatment to the various straight and curved wall surfaces in the foregoing manner.

Considering the apparatus of the present invention, certain basic features of the apparatus according to the invention will be explained with reference to FIG. 2. Like structure to that shown schematically in FIG. 1 bears like reference numerals. In this FIG. 2 at least two flat tank wall parts respectively indicated by reference numerals 1 and 2 are shown. The flat wall parts 1 and 2 are interconnected by a curved tank wall part 3, the latter having the shape of part of a cylinder having a central axis 9, so that the axis 9 forms the axis of curvature of curved wall part 3.

A first set of straight guide rails 4 including an upper and a lower pair of spaced, parallel guide rails are arranged parallel to, and are spaced apart from, the flat wall part 1 and second set of straight guide rails 5 including an upper and a lower pair of spaced, parallel guide rails are arranged parallel to, and are spaced apart from the flat wall part 2.

Between said first and second guide rails 4 respectively 5, a traverser 6 is arranged. The traverser 6 carries, an upper and a lower pair of parallel, spaced straight guide rails 7. A trolley 8 is so constructed that it can slide or roll along the various guide rails 4, 5 and 7. The trolley 8 is adapted to carry a suitable treating tool, for example a spraying nozzle (see FIG. 1) for spraying polyurethane foam onto the inner surfaces of the tank wall parts 1, 2 and 3. The traverser 6 is so arranged between the said first and second straight guide rails 4 and 5 that it can rotate around the axis 9. The axis 9 is the axis of curvature of the curved wall part 3, which has a radius of curvature R. The traverser 6 is adapted to rotate through an angle designated by reference numeral B around the axis 9 from a first position wherein the guide rails 7 on the traverser 6 are in line with the first guide rails 4 to a second position wherein the guide rails 7 on the traverser 6 are in line with the second guide rails 5. Suitable driving means to be set forth below are present for displacing the trolley 8 along the first and second guide rails 4 and 5, respectively, and for displacing the trolley 8 along the guide rails 7 on the traverser 6 and for rotating the traverser 6 from the first to the second position.

In a suitable embodiment of the invention the driving means includes a motor 18, for example an electric motor, mounted on the trolley 8 and adapted to drive a pinion 10 on the trolley 8. The pinion 10 is adapted to co-operate with a first straight rack 11 arranged parallel to the first guide rails 4, with a second straight rack 12 arranged parallel to the second guide rails 5 and with a curved rack 13 arranged between and interconnecting the first straight rack 11 and the second straight rack 12. The center of curvature of the curved rack 13 lies on the axis 9 and the radius of curvature of the curved rack 13 is the radius $R_1$.

The above arrangement is such that when the pinion 10 is driven by the motor, rotation of the pinion 10 causes the latter to co-operate with the racks 11, 12 and 13 in such a manner that the trolley 8 will be displaced with respect to the walls 1, 2 and 3, respectively. For example, co-operation between the pinion 10 and the first rack 11 will cause displacement of the trolley 8 along the first guide rails 4 in the direction along the wall 1 indicated by an arrow A. When the trolley 8 moves along the guide rails 4 the traverser 6 is in the first position as indicated in FIG. 2. In this first position of the traverser 6, the guide rails 7 on the traverser 6 are in line with the first guide rails 4 as shown. The traverser 6 is locked in this first position by a locking lever 15 which is rotatable around a pin 16 on the traverser 6 and which grips behind a cam 17. This position of the traverser 6 enables the trolley 8 to leave the first guide rails 4 and to move onto and along the guide rails 7 on the traverser 6. When the pinion 10 reaches the end of the first rack 11 (indicated by the chain-dotted line P) the trolley 8 has completely moved onto, and is completely supported by and, locked onto the guide rails 7 on the traverser 6.

The traverser 6 is then unlocked, in a manner to be set forth, from the guide rails 4 and the pinion 10 co-operates with the curved rack 13. Rotation of the pinion 10 causes it to run along the curved rack 13 so that the traverser 6, together with the trolley 8 locked to the traverser 6, reaches a second position wherein the guide rails 7 on the traverser 6 are in line with the second guide rails 5. In this second postion the traverser 6 is locked to the guide rails 5 by means of a locking lever 31 which is rotatable around a pin 32 on the traverser 6 and is caused to grip behind a cam 33 to effect such locking.

In said second position of the traverser 6 the trolley 8 is unlocked therefrom, in a manner to be set forth, and the pinion 10 is able to leave the end of the curved rack 13 (indicated by chain-dotted line Q) and starts to run along the second rack 12. This causes the trolley 8 to leave the guide rails 7 on the traverser 6 and to move along the second guide rails 5.

The mechanism for locking the traverser 6 in the said first and second positions and the mechanism for locking the trolley 8 to the traverser 6 includes a cam 36 which is provided with a recess 35 and mounted on the side of upper guide rail 7 of the traverser 6. The cam 36 is mounted on a pin 37 which is rotatably mounted on the traverser 6. The pin 37 carries a pinion 38 which is adapted to cooperate with a rack 39. The rack 39 is fixed to a bar 40, which is so mounted between the upper guide rails 7 on the traverser 6 that it is axially displaceable. The opposite ends of the bar 40 are secured to the locking lever 15 and 31, respectively.

The traverser 6 also carries a bar 41 which is mounted in guide means 42 on the side of upper guide rail 7 in such a manner that it is axially displaceable on the traverser 6. The ends of the bar 41 are adapted to cooperate with fixed cams indicated respectively by the reference numerals 43 and 44 on the guide rails 4 and 5, respectively. Cams 45 and 46 are mounted on the bar 41 along intermediate portions thereof, being adapted to cooperate through suitable openings in the guide rail 7 with the bar 40. A pin 34 is present on the trolley 8 and is adapted to cooperate with the recess 35 in the rotatable cam 36.

Figure 2:
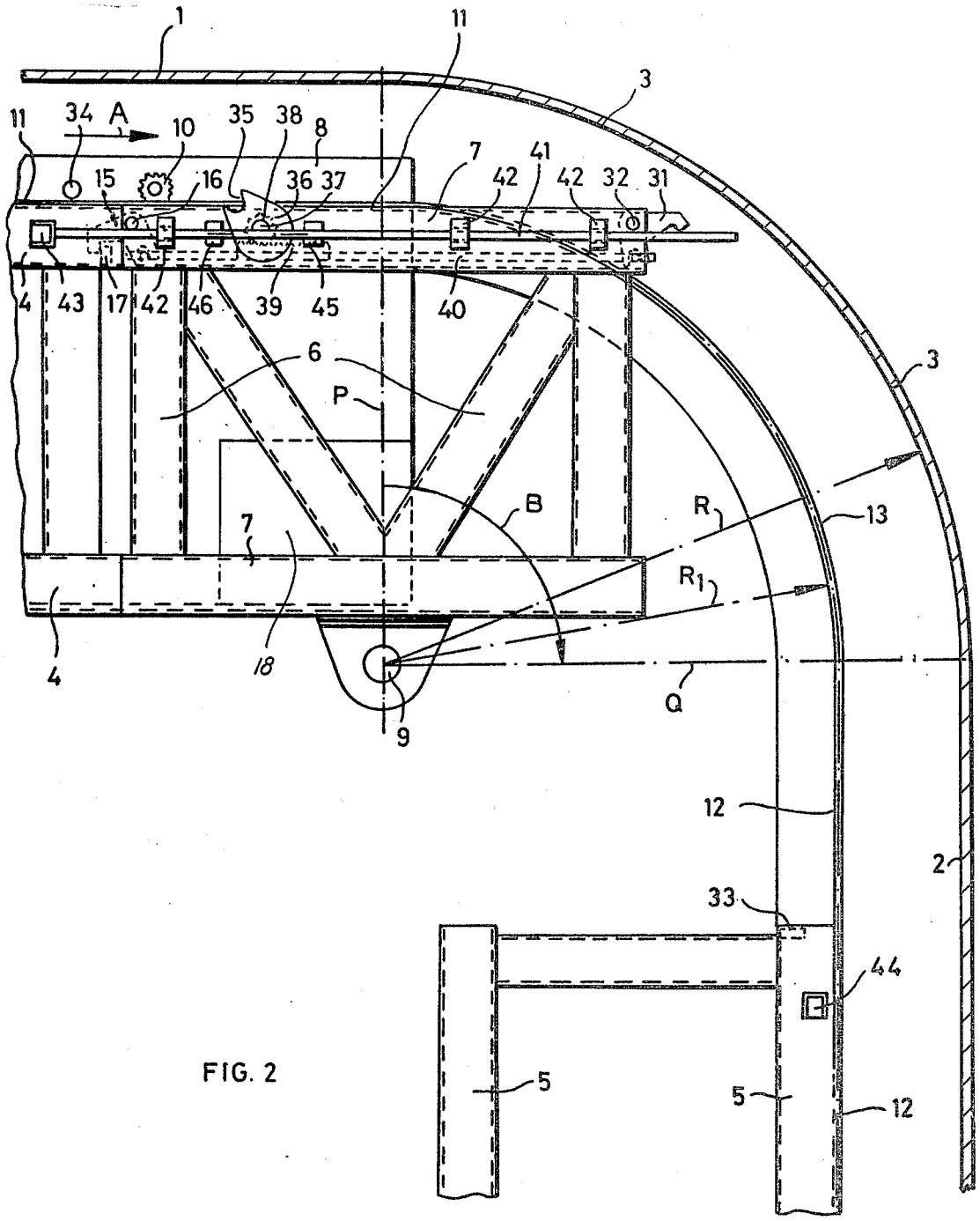
FIG. 2 shows a vertical cross section of a corner part of a tank and structural elements of an apparatus according to the invention.

The operation of the structure shown in FIG. 2 begins when the trolley 8 is moving along the guide rail 7 on the traverser 6. At a certain position, the pin 34 enters the recess 35 in the rotatable cam 36 causing rotation of the rotatable cam 36 to a position wherein the longitudinal axis of the cam 36 is parallel to the line P. In this position the trolley 8 is locked to the traverser 6. The pinion 38 on the pin 37 rotates together with the cam 36 over the same angle as the cam 36 during rotation thereof. The pinion 38 also cooperates with the rack 39 on the bar 40, so that rotation of the pinion 38 causes axial displacement of the bar 40 leftwardly as seen in FIG. 2. This displacement of the bar 40 causes both locking levers 15 and 31 to turn in the clockwise direction over a certain angle, so that the lever 15 is just free from the cam 17, unlocking the traverser 6 from the guide rails 4 and the lever 31 will be able to pass the cam 33, for reasons to be set forth below.

At this stage the trolley 8 is locked to the traverser 6 and the traverser 6 itself is unlocked from the guide rails 4. Further rotation of the pinion 10 causes the pinion 10 to run along the curved rack 13 causing rotation of the traverser 6 together with the trolley 8 around the axis 9. This rotation of the traverser 6 is continued until the traverser 6 has reached the second position wherein the guide rails 7 on the traverser 6 are in line with the second guide rails 5.

Just before the traverser 6 reaches this second position the lever 31 passes the cam 44 and the end of the bar 41 hits the fixed cam 44 causing axial displacement of the bar 41. This axial displacement of the bar 41 causes the cam 45 to act on the bar 40 in such a way that bar 40 is further displaced axially and both locking levers 15 and 31 are rotated further in clockwise direction so that the locking lever 31 grips around the cam 33 and the traverser 6 is locked in the second position to the guide rails 5. This displacement of the bar 40 causes as well a further clockwise rotation of the rotatable cam 36 by the action of the rack 39 on the pinion 38. The cam 36 is rotated to such a degree that the pin 34 on the trolley 8 is free to leave the recess 35 in the rotatable cam 36. In the second position the trolley 8 is in this manner unlocked relative to the traverser 6 and the trolley 8 is thus free to leave the traverser 6.

At this stage wherein the traverser 6 is locked in said second position to the guide rails 5 and the trolley 8 is unlocked relative to the traverser 6, further rotation of the pinion 10 causes the pinion 10 to run along the rack 12 so that the trolley 8 is displaced along the guide rails 5.

An important field of application of the apparatus according to the invention is the treatment of the inner surfaces of tanks for liquefied gases, in particular ship's tanks for the transport of liquefied natural gas or liquefied methane. These tanks are basically prismatic, with the corners between intersecting walls rounded off in the manner described above. The inner surfaces of such tanks are covered with polyurethane foam by spraying. Furthermore laminates of glass-fibre material and epoxy resin have to be applied to the polyurethane foam. In order to apply such a laminate to the polyurethane foam, the apparatus according to the invention can be used with great advantage. For this purpose a laminating apparatus (not shown) has to be mounted on the trolley 8 as the treating tool.

Figure 3:
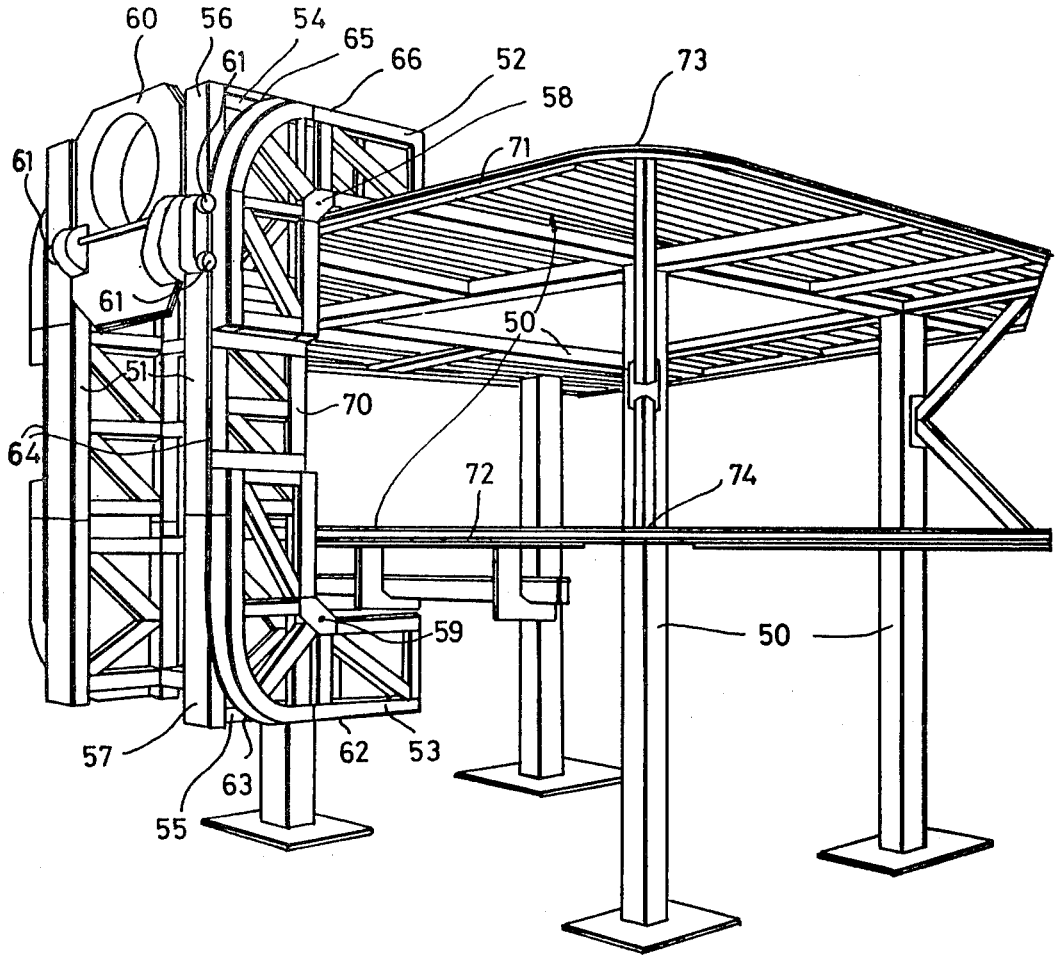
FIG. 3 shows in perspective a general arrangement of an embodiment of an apparatus according to the invention.

In FIG. 3 a general arrangement of an embodiment of the apparatus according to the invention is shown in perspective. It comprises a structure 50 which is adapted to be supported by a bottom wall of a tank to be treated and carrying straight guide rails 51, 52 and 53. The guide rails 51, 52 and 53 are of like construction to the guide rails 4 and 5 of FIG. 2 and are adapted to be arranged parallel to flat wall parts of a tank (not shown). For example in the case of a prismatic tank having corners which are rounded off, the guide rails 53 are arranged parallel to, and spaced apart from, the flat bottom wall of the tank, the guide rails 51 are arranged parallel to, and spaced apart from, a flat side wall of the tank and the guide rails 52 are arranged parallel to, and spaced apart from the flat top wall of the tank. Between guide rails 51 and 52 a traverser 54 is arranged and between guide rails 53 and 51 a traverser 55 is arranged. The traversers 54 and 55 are of like construction to the traverser 6 of FIG. 2. Further, the traverser 54 carries straight guide rails 56 and the traverser 55 carries straight guide rails 57. Furthermore the traverser 54 is rotatable around an axis 58 and the traverser 55 is rotatable around an axis 59.

The structure 50 is so arranged in the tank to be treated that the axis 58 coincides with the axis of curvature of the curved wall part between the side wall and the top wall of the tank and that the axis 59 coincides with the axis of curvature of the curved wall part between the side wall and the bottom wall of the tank. A trolley 60 (of like structure to the trolley 8 of FIG. 2) is present and is adapted to run along the various guide rails of FIG. 3. The trolley 60 is adapted to carry a tool (not shown) for treating the surfaces of the tank in the manner described above. Furthermore the trolley 60 is provided with pinions 61 (corresponding in structure and operation to the pinion 10 of FIG. 2) which are adapted to run along various straight and curved racks 62, 63, 64, 65 and 66.

In the embodiment as shown in FIG. 3, the various elements as described in the above are mounted on a carriage 70. This carriage 70 is adapted to run along horizontal guide rails 71 and 72 on the structure 50. By arranging similar traversers (not shown) at the corners 73 and 74 of the structure 50, but rotatable around a vertical axis which coincides with the axis of curvature of a curved wall part between two vertical side walls of the tank, it is not only possible to treat such curved wall part, but moreover it is possible to treat flat and curved wall parts of the tank adjacent to the earlier mentioned flat and curved wall parts of the tank.

By means of the apparatus according to FIG. 3, the flat bottom, side and top walls of a prismatic tank having rounded off corners can be treated, as well as the curved wall parts between said flat walls. This treatment of the tank walls can be carried out in a stripwise manner. After a first strip has been completed the treatment of an adjacent strip is started after the carriage 70 has been displaced along the guide rails over the required distance.

It should be understood that the foregoing example of treating a surface of a tank wall is given only by way of example and that other treating operations, such as spraying a paint onto a surface; spraying an anti-corrosion material onto a surface; cleaning a surface; sandblasting a surface; grinding a surface; applying a laminate onto a surface; and even rolling a surface, may be performed according to the present invention, if desired. In these instances, a suitable treating tool such as a spraying tool, a cleaning tool, a sandblasting tool, a grinding tool, a laminating tool and a rolling tool is used.

The foregoing disclosure and description of the invention are illustrative and explanatory thereof, and various changes in the size, shape and materials as well as in the details of the illustrated construction may be made without departing from the spirit of the invention.

We claim:

1. An apparatus for treating internal surfaces of the walls of a tank, by spraying an insulating material onto the tank walls or the like, including at least two flat wall parts interconnected by a curved wall part, which apparatus comprises: a trolley for carrying a treating tool; a first straight guide rail for said trolley arranged parallel to and spaced apart from one of the two flat wall parts; a second straight guide rail for said trolley arranged parallel to and spaced apart from the other of the two flat wall parts; a traverser carrying a straight guide rail for the trolley; and means for locking said trolley to said traverser; said traverser being mounted between said first and second guide rails for rotational movement around an axis which coincides with the axis of curvature of the curved wall part; said traverser further being rotatable from a first position wherein said guide rail on said traverser is in line with said first guide rail to a second position wherein said guide rail on said traverser is in line with said second guide rail; and driving means for displacing said trolley along said first guide rail and along said guide rail on said traverser, and further for rotating said traverser from said first position to said second position while said trolley is locked on said traverser and for displacing said trolley along said second guide rail.

2. An apparatus as claimed in claim 1, comprising means for varying the angular velocity of said traverser around its axis.

3. An apparatus as claimed in claim 1, further including means for varying the velocity of said trolley along said guide rails.

4. An apparatus as claimed in claim 1, further including means for establishing a predetermined relationship between the angular velocity of said traverser around its axis and the velocity of said trolley along said guide rails.

5. The apparatus as claimed in claim 1 said further including a first straight rack arranged parallel to said first straight guide rail, a second straight rack arranged parallel to said second straight guide rail and a curved rack arranged between and interconnecting said first and second straight racks.

6. The apparatus as claimed in claim 5, wherein said driving means for displacing said trolley along said guide rails comprises a pinion on said trolley and a motor on said trolley for driving said pinion, said pinion co-operating with a rack on said first and second guide rails.

7. The apparatus as claimed in claim 5, wherein said driving means for rotating said traverser comprises a pinion on said trolley and a motor for driving said pinion, said pinion cooperating with said curved rack.

8. The apparatus as claimed in claim 5, further including means for varying the angular velocity of said pinion.

9. The apparatus as claimed in claim 1, wherein said guide rails for said trolley, said trolley and said traverser are mounted on a carriage, and wherein said carriage is displaceable along straight guide rails parallel to a tank surface to be treated.

* * * * *